United States Patent [19]

Morgan

[11] 4,359,382

[45] Nov. 16, 1982

[54] MAGNETIC STRUCTURE FOR A MAGNETIC SEPARATOR

[75] Inventor: Donald G. Morgan, Milwaukee, Wis.

[73] Assignee: Magnetics International, Inc., Maple Heights, Ohio

[21] Appl. No.: 265,052

[22] Filed: May 15, 1981

[51] Int. Cl.[3] ..... B03C 1/14

[52] U.S. Cl. ..... 209/223 A; 209/232

[58] Field of Search ..... 209/222 R, 223 A, 232; 210/222, 223; 335/304

[56] References Cited

U.S. PATENT DOCUMENTS

| | | | |
|---|---|---|---|
| 3,209,912 | 10/1965 | Sloan | 209/223 R |
| 3,489,280 | 1/1970 | Israelson | 209/223 R |
| 4,185,262 | 1/1980 | Watanabe | 335/303 X |

FOREIGN PATENT DOCUMENTS

| | | | |
|---|---|---|---|
| 160430 | 11/1938 | Austria | 209/223 R |
| 160503 | 6/1941 | Austria | 209/223 R |
| 53-47806 | 6/1978 | Japan | 209/232 |
| 582835 | 12/1977 | U.S.S.R. | 209/223 R |
| 659187 | 4/1979 | U.S.S.R. | 209/223 A |
| 751427 | 7/1980 | U.S.S.R. | 209/223 A |

*Primary Examiner*—Tim R. Miles

*Attorney, Agent, or Firm*—Wegner, McCord, Wood & Dalton

[57] ABSTRACT

An improved magnetic structure for a magnetic ore separator has an arcuate base attached to a support which in turn is connected to end pieces which mount shaft connectors by which the magnetic structure is mounted on a shaft. A plurality of radial elements are positioned in spaced relationship between the base and an outer cover. A plurality of azimuthal elements are positioned on the base between the radial elements. A plurality of angled elements are positioned between the radial elements and the azimuthal elements. The direction of magnetization of each element is displaced angularly from that of the adjacent element in uniform increments of less than 90°.

6 Claims, 5 Drawing Figures

FIG. 2
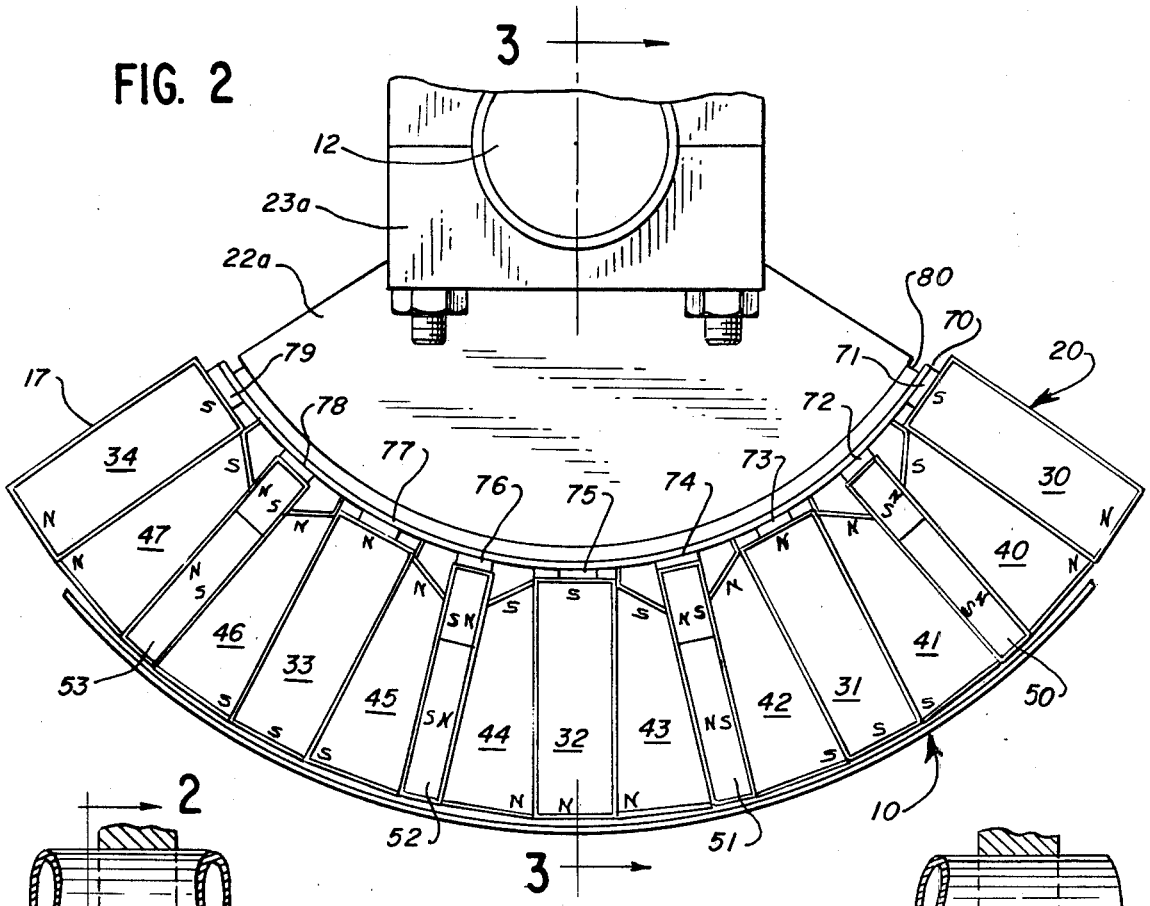
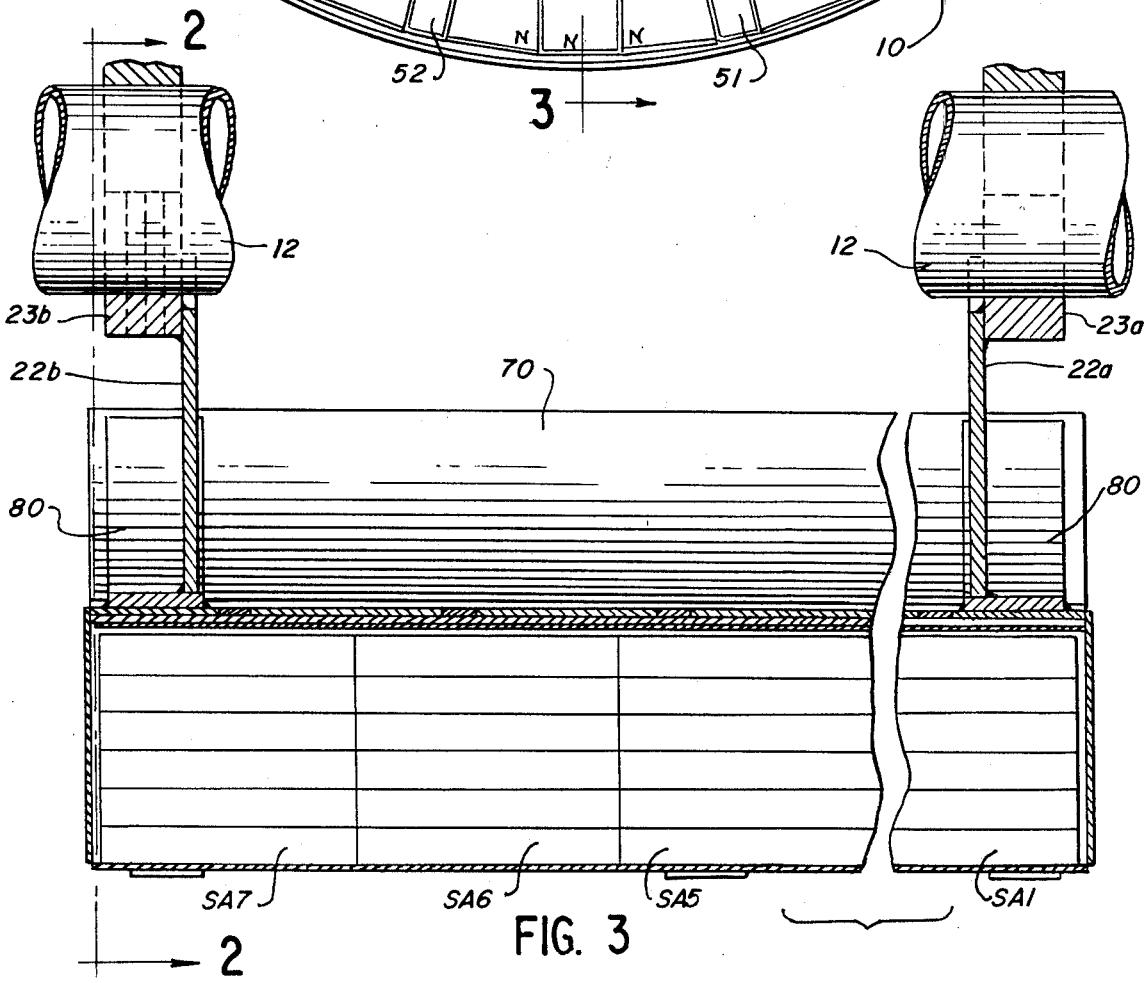
FIG. 3

MAGNETIC STRUCTURE FOR A MAGNETIC SEPARATOR

TECHNICAL FIELD

This invention relates to an improved magnetic structure in a magnetic separator for separating magnetic products from non-magnetic material.

BACKGROUND ART

Prior magnetic structures for use in a magnetic separator typically utilize an arrangement wherein magnets alternate between a radially polarized direction and a direction perpendicular to the radius, commonly referred to as the azimuthal direction. Furthermore, a structure of low reluctance material is added to the rear of the magnetic structure to further decrease leakage flux and to increase the field in the vicinity of a working surface, past which the magnetic material and waste material pass.

Although these apparatus effectively control leakage flux, the field is nonuniform in the vicinity of the working surface. Specifically, portions of the magnetic field corresponding to decreased magnetic strength occur as the magnetic field is traversed.

It is desirable to provide a uniform field in the vicinity of the working surface and to also minimize leakage flux occurring behind the magnetic assembly. Furthermore, it is desirable to maximize the gradient of the radial component of the magnetic field because the force acting upon a particle within the field is proportional to this gradient. In this manner, the field strength increases quickly at the edges of the field, and hence fewer magnets need be employed to separate the magnetic product from the non-magnetic material.

DISCLOSURE OF INVENTION

The present invention is directed to overcoming one or more of the problems as set forth above.

In one aspect of the present invention, which may take a variety of forms, an improved magnetic structure for a magnetic separator includes a first plurality of magnetic elements magnetized in a radial direction and spaced uniformly on a base. A second plurality of magnetic elements, polarized in an azimuthal direction perpendicular to the radial direction, are spaced uniformly between the radial elements. A third plurality of magnetic elements, polarized in a direction intermediate of the radial and azimuthal directions are positioned between the radial elements and the azimuthal elements. The magnetic elements are arranged so that as an arc is travelled from one end of the magnetic structure to the other, the magnetization direction of an element is displaced angularly in steps with respect to the adjacent element. The gradient of the radial component of the field is maximized, as is the field strength, and the displaced angular magnetization direction from element-to-element insures uniformity of field in the vicinity of the working surface. Additionally, the magnetic field is made deeper for a given number of magnets.

BRIEF DESCRIPTION OF DRAWINGS

FIG. 2 is a sectional view of the improved magnetic structure taken along line 2—2 of FIG. 3;

FIG. 3 is a sectional view of the improved magnetic structure taken along line 3—3 of FIG. 2;

BEST MODE FOR CARRYING OUT THE INVENTION

Figure 1:
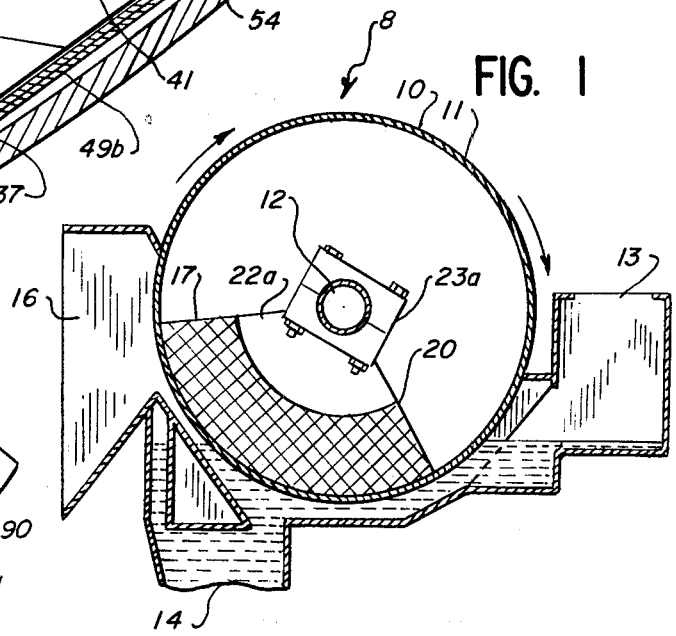
FIG. 1 is a diagrammatic view of a magnetic separator incorporating the present invention.

Referring to FIG. 1, a wet-type magnetic drum separator 8 incorporating one version of the improved magnetic structure of the present invention is illustrated. It should be understood that other embodiments of the present invention, some of which are described herein, can be viewed as being logical extensions of the basic concept found in the illustrated embodiment. Furthermore, the improved structure can be used in conjunction with a dry-type magnetic drum separator as well as a magnetic pulley, an in-line separator, a cross-belt separator, or any other magnetic separator.

The wet-type magnetic drum separator 8 includes a drum 10 having an outer surface 11 mounted on a fixed shaft 12 for rotation. The drum may be driven by a motor (not shown). Also mounted on the shaft 12 in fixed relation thereto is the improved magnetic structure, generally labelled 20, which is mounted on the shaft 12 by end pieces **22*a* and 22*b* and shaft connectors 23*a* and 23*b*. An inlet conduit 13 is provided into which the slurry is deposited. An outlet conduit 14 is located below the drum 10 and a chute 16 is located outside the drum 10 adjacent the terminus 17 of the magnetic structure 20**.

Material containing magnetic and non-magnetic particles is mixed with water to form a slurry and is directed into the inlet conduit 13. The material is then directed against the outside surface 11 of the drum 10 where the magnetic field of the improved magnetic structure 20 attracts the magnetic particles. As the drum 10 rotates in the direction shown by the arrows, the magnetic particles rotate due to the alternating fields induced by the magnetic structure 20. This rotation tends to loosen the non-magnetic particles away from the magnetic product. The non-magnetic material falls to the outlet conduit 14 leaving the magnetic particles still attached to the drum 10. The drum 10 continues to convey the magnetic particles in a clockwise direction until the particles are rotated to the end of the magnetic structure. When the particles reach the terminus 17 of the magnetic structure 20, the particles fall off the drum 10 and exit the separator at chute 16.

Referring now to FIG. 2, one version of the improved magnetic structure 20 of the present invention is illustrated. The improved magnetic structure 20 includes a plurality of radial elements 30, 31, 32, 33 and 34. The radial elements 30–34 are magnetized in a direction parallel to the radius of the magnetic structure 20. The radial elements 30–34 are arranged so that any two adjoining radial elements have reversed magnetizations, i.e. in the illustrated embodiment, radial element 30 has its north pole closest to the drum 10 while radial element 31 has its south pole closest to the drum 10.

Also included in the magnetic structure 20 are a plurality of azimuthal elements 50, 51, 52 and 53. Each azimuthal element 50–53 is spaced between adjacent radial elements. The azimuthal elements 50–53 are magnetized in a direction perpendicular to the radius of the magnetic structure 20.

Spaced between the radial elements 30–34 and the azimuthal elements 50–53 are angled elements 40, 41, 42, 43, 44, 45, 46 and 47. The angled elements 40–47 are arranged so that the angled elements adjacent a radial element have the same polarity, i.e. angled elements 41 and 42 have their south poles closest to the drum 10 along with radial element 31. The angled elements 40–47 are magnetized in a direction intermediate of the radial and azimuthal directions.

The elements are thereby arranged to form alternating poles about the outside of the magnetic structure 20, e.g., elements 32, 43 and 44 forming a north pole directed to the outside of the magnet assembly 20 while elements 31, 41 and 42 present a south pole directed toward the outside of the magnetic structure 20. In the illustrated embodiment, this arrangement forms five poles of alternating polarity disposed about the outer circumference of the magnetic structure 20, the center of each pole (i.e., the center of the radial element) being separated 28° from the adjacent pole to form a structure of 112° total arc measured from the center of radial element 30 to the center of radial element 34. In other embodiments, the polarities of the poles may be reversed and the angular distance between adjoining poles will vary as the number of elements or the number of poles changes.

Referring to FIG. 3, the magnetic structure 20 is actually made up of a plurality of separate magnet subassemblies SA1–SA7 butted end-to-end. In the illustrated embodiment, each subassembly may be 7" deep, hence the magnetic structure 20 is a total of 49" in depth from one axial face to the other; however, the depth of each subassembly may be made shorter or longer.

Figure 4:
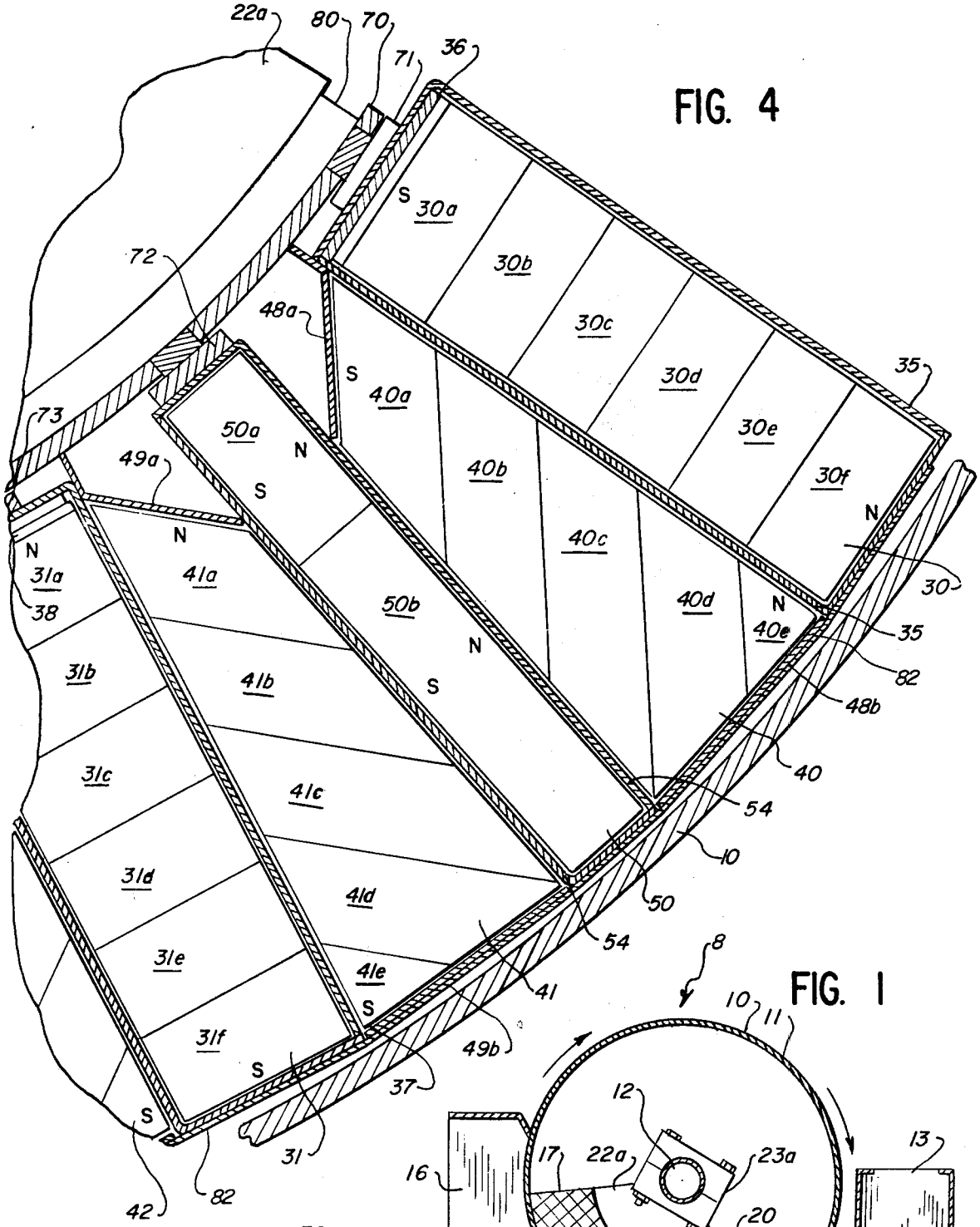
FIG. 4 is an enlarged, fragmentary view of FIG. 2 showing a portion of the improved magnetic structure.

Referring now to FIG. 4, there is illustrated an enlarged view of a portion of the magnetic structure 20. As the magnetic structure 20 is comprised of three basic elements, i.e. radial elements 30–34, azimuthal elements 50–53 and angled elements 40–47, a description of one of each type of element will suffice.

Each element is made up of separate blocks of a high energy product, high coercive magnetic material, such as barium or strontium ferrite or other permanent magnet materials. The radial, angled, and azimuthal elements differ only in their geometric configurations and in their direction of magnetization, which is generally taken as being at some angle with respect to a line drawn from the center of the shaft 12 to the drum 10, hereinafter referred to as the radius. For the sake of convenience, a counterclockwise direction as observed by the reader with respect to the radius will be referred to as a negative angle and the direction of magnetization of each element will point from the south pole through the interior of the element towards the north pole.

The radial elements, as typified by radial element 30, are made up of a series of blocks **30*a*–30*f* connected in series so that a pole of one block abuts an opposite pole of the adjacent block. Although six blocks 30*a*–30*f* are shown, it is to be understood that any appropriate number of blocks will suffice. The direction of magnetization of the radial element is at an angle of 0° with respect to the radius. The radial element 30 is encased in a stainless steel housing 35 which restrains the individual blocks from movement. Spacers 36, which may not be needed or which may be of any number, may be used to assist in securing the blocks in place so as to prevent relative movement of the magnets 30*a*–30*f* within the housing 35**.

Angled element 40 consists of a number of irregularly-shaped blocks, labelled **40*a*–40*e*, located adjacent to the housing 35 of radial element 30. Although five blocks 40*a*–40*e* are shown, it is to be understood that any appropriate number of blocks will suffice. The blocks 40*a*–40*e* abut each other in a series fashion, such that the direction of magnetization is at some angle with respect to the radius. In the illustrated embodiment, the angled element 40 has a direction of magnetization of −45° with respect to the radius. The angled element 40 is held in place by angled element supports 48*a* and 48*b*, made of stainless steel, and by housing 35 of the radial element 30 and a housing 54 of the azimuthal element 50**.

The azimuthal element 50 is made up of blocks **50*a* and 50*b* connected in parallel so as to form a direction of magnetization of −90° with respect to the radius. Although two blocks 50*a*, 50*b* are shown, it is to be understood that any appropriate number of blocks will suffice. The azimuthal element blocks 50*a* and 50*b* are held in place by a stainless steel housing 54**.

Angled element 41 is made up of blocks **41*a*–41*e* similar to blocks 40*a*–40*e* of angled element 40. However, the direction of magnetization of angled element 41 is −135° with respect to the radius. Angled element 41 is held in place by angled element supports 49*a* and 49*b* similar to angled element supports 48*a* and 48*b* of angled element 40 and by housing 54 and a housing 37 of radial element 31**.

Radial element 31 is identical to radial element 30 except that the direction of magnetization is displaced 180° with respect to the radius. The blocks **31*a*–31*f* are held in place by the housing 37. Spacers 38, which may not be needed or which may be of any number, may be used to assist in securing the blocks in place so as to prevent relative movement of the magnets 31*a*–31*f*** within the housing.

The direction of magnetization of the blocks will continue in a counterclockwise direction by angular increments. Therefore, the direction of magnetization of radial element 32 is at 0° with respect to the radius, the direction of magnetization of radial element 33 is at 180° with respect to the radius, and the direction of magnetization of radial element 34 is at 0° with respect to the radius.

Each of the radial and azimuthal element housings and angled element supports are welded to a base 70 by means of spacers 71–79. The base 70 is welded to a support 80, which in turn is welded to the end pieces **22*a* and 22*b* to which are welded the shaft connectors 23*a* and 23*b*, respectively. Each of the magnetic elements are connected to an outer cover 82** to prevent relative movement of the elements. The individual blocks of the elements are inserted into the housings and angled element supports which are then welded shut to keep the blocks in place.

The number and dimensions of individual blocks which comprise an element may be varied, as well as the number of subassemblies, depending upon the particular application for which the improved magnetic structure is to be used. Similarly, the number of poles contained in the improved magnetic structure 20 may be increased or decreased and the magnetic arc may be varied to provide magnetic fields of different geometries. Furthermore, elements having azimuthal or angled magnetizations may be used at the edges instead of radial elements and the particular angle of magnetization of the angled elements may be varied from the 45° displacement angle illustrated.

INDUSTRIAL APPLICABILITY

Referring again to FIGS. 2 and 4, the angular displacement of direction of magnetization of each succeeding magnetic element provides a highly uniform resultant field which builds up rapidly at the edges of the field. Furthermore, a stronger and deeper field is produced which has a large gradient of the radial component of the field, thereby increasing the force acting on magnetic particles. In the embodiment shown, the field has been determined to be substantially greater than fields of other designs.

Magnetic structures utilizing only radial and azimuthal elements exhibit variations in the magnetic field along the circumference of the magnetic arc. These variations are minimized in the embodiment shown by the addition of angled elements 40–47 whose contribution to the total magnetic field serves to augment and spread the field intensity.

The azimuthal elements 50–53 are arranged such that the polarities of an azimuthal element and the adjacent angled element are opposite at the rear of the magnetic structure 20 adjacent the base 70. This completes a magnetic circuit which minimizes leakage flux which would occur behind the elements away from the working surface defined by the outer surface 11 of the drum 10. Therefore, a greater amount of flux can be directed to the vicinity of the working surface.

Figure 5:
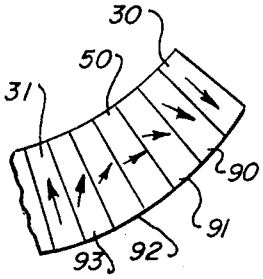
FIG. 5 is a schematic diagram of another embodiment of the improved magnetic structure.

Referring to FIG. 5, while the invention has been described with magnetization which varies by 45° from element-to-element, other embodiments may be used in which a different angle is used, such as 30°. This would require two subsets of angled elements, one of each subset interposed between the radial and azimuthal elements, namely, one subset at −30°, typified by elements 90 and 92, and one at −60°, typified by elements 91 and 93. This embodiment would further increase the uniformity and strength of the field. Other multi-angular arrangements can also be realized utilizing different angular displacements.

The invention herein described is not limited to use in a wet-type magnetic drum separator. The invention is also applicable to dry-type magnetic drum separators, whereby, the diameter or the number of poles would change, or where a highly uniform magnetic field is required.

The invention is also applicable to a permanent magnetic pulley, which could consist of as much as 360° of arc, and having the entire element rotating, rather than stationary, as explained in the embodiment of this invention.

Other aspects, objects and advantages of this invention can be obtained from a study of the drawings, the disclosure and the appended claims.

I claim:

1. In a magnetic separator having a rotating drum, an improved arcuate magnetic structure, comprising:

a first set of spaced-apart magnetic elements having radial directions of magnetization;

a second set of magnetic elements, the elements of the second set being interposed between and spaced from adjacent first magnetic elements and having azimuthal directions of magnetization; and at least a third set of magnetic elements between said first and second magnetic elements having directions of magnetization angularly oriented between the radial and azimuthal magnetizations of the first and second sets of elements.

2. The magnetic structure of claim 1 wherein each element of the third set has a magnetization direction angularly displaced 45° from that of the adjacent elements.

3. The magnetic structure of claim 1 wherein the third set of magnetic elements includes first and second subsets, each element of the first subset positioned adjacent each element of the second subset so that the direction of magnetization of each element is angularly displaced 30° from that of the adjacent elements.

4. In a magnetic separator having a rotating drum, an improved arcuate magnetic structure, comprising:

a first set of magnetic elements, angularly spaced apart and each having a radial direction of magnetization with the magnetization directions of adjacent elements in said set being reversed;

a second set of magnetic elements interposed between and spaced from adjacent magnetic elements of said first set, each of said second set of magnetic elements having an azimuthal direction of magnetization with the magnetization of adjacent elements in said second set being reversed; and a third set of magnetic elements interposed between adjacent magnetic elements of the first and second sets and each of said third set of magnetic elements having a direction of magnetization angularly oriented between the radial and azimuthal magnetization of the adjacent elements of the first and second sets.

5. The magnetic structure of claim 4 wherein the direction of magnetization of each element of said third set bisects the angle between the magnetization direction of the adjacent magnetic elements of the first and second sets.

6. The magnetic structure of claim 4 wherein the third set of magnetic elements includes first and second subsets, each element of the first subset positioned adjacent each element of the second subset so that the direction of magnetization of each element is angularly displaced 30° from that of the adjacent elements.

* * * * *